United States Patent [19]

Ting

[11] Patent Number: 4,765,107

[45] Date of Patent: Aug. 23, 1988

[54] VERTICAL JOINT SEALING OF HORIZONTAL WALL PANELS

[76] Inventor: Raymond M. L. Ting, 318 Holiday Dr., Pittsburgh, Pa. 15237

[21] Appl. No.: 109,834

[22] Filed: Oct. 19, 1987

[51] Int. Cl.[4] ..... E04B 1/66

[52] U.S. Cl. ..... 52/235; 52/302; 52/503; 52/533

[58] Field of Search ..... 52/235, 97, 589, 591, 52/592, 593, 594, 595, 460–463, 470–472, 403, 404, 533–535, 503, 302

[56] References Cited

U.S. PATENT DOCUMENTS

| | | | |
|---|---|---|---|
| 4,037,377 | 7/1977 | Howell et al. | 52/592 |
| 4,316,351 | 2/1982 | Ting | 52/595 |
| 4,672,784 | 6/1987 | Pohlar | 52/302 |
| 4,700,520 | 10/1987 | Ting | 52/520 |

*Primary Examiner*—James L. Ridgill, Jr.
*Attorney, Agent, or Firm*—William J. Ruano

[57] ABSTRACT

This invention relates to the water tight performance of exterior panel wall systems erected in the horizontal mode. A water tight exterior wall system is accomplished by providing a pressure equalized chamber and a water drainage groove in front of the primary sealant lines without using an internal drainage system.

10 Claims, 3 Drawing Sheets

VERTICAL JOINT SEALING OF HORIZONTAL WALL PANELS

BACKGROUND OF THE INVENTION

1. Field of the Invention

This invention relates to exterior building wall systems utilizing wall panels in horizontal application. The wall panels are fastened to spaced apart vertical mullions which are secured to the exterior building perimeter frames. The wall surface is formed by multiple wall panels joined together along their side edges to form the horizontal joints and spaced apart between the panel ends at the panel end supporting mullion locations to form the vertical joints of the wall system. This type of panel arrangement is known as horizontal application of wall panels. This invention relates to the methods of sealing the vertical joint to prevent water leakage in the horizontally applied exterior wall panel systems.

2. Description of the Prior Art

Any wall panels having water repellent end closures are useful in a horizontal wall panel system. To seal the panel joints including horizontal and vertical joints, the use of caulking, gasket, or the combination thereof is well known in the art. It is also well known that perfect air tight seal is difficult if not impossible to achieve no matter what type of sealant is used due to the variations of workmanship and relative joint movement induced by thermal and wind loads.

Therefore, to provide a water tight exterior wall system, other provisions must be added to the sealing system. The following three methods of sealing the panel joints are known in the art.

Method 1 is to seal the joints behind the exterior wall surface within the panel depth and to provide an internal drainage system incorporating internal horizontal gutters at each level of horizontal joints. Since internal darinage system is provided, the wall system will achieve water tight performance if the joints in the internal gutters are maintained in good condition. However, the addition of the internal gutter system is expensive and thus, the system is normally used in the high priced wall system.

Method 2 is to seal the joints at the exterior surface of the wall with curable caulking and to provide an internal drainage system which is simpler and less costly than Method 1 to drain the water out at intermittent levels or at the wall base. This method is normally used in the medium priced wall system. The water tight performance of this system is usually good also.

Method 3 is to seal the horizontal joint within the panel depth and to seal the vertical joint to the mullion and to cover the vertical joint with a joint cover for appearance purpose. This method is most economical and is usually used in the low priced wall sysstem. However, since there is no internal drainage system in this method, numerous failures of water tight performance have been reported for jobs utilizing this method due to water leakage through the vertical panel joints.

Typical application of this method are seen in the construction utilizing composite foam panels or honeycomb panels.

SUMMARY OF THE INVENTION

The objective of this invention is to provide an economical and effective water tight vertical joint sealing system for horizontal exterior wall panel systems without using an internal drainage system.

The working principles of this invention are described below.

Principle 1: Pin holes in any sealant line will be developed due to workmanship and joint movements induced by thermal load or wind load.

Principle 2: Due to the surface tension of water drop, vertically running water along a small gap joint will not penetrate through the small gap if the air pressure on both sides of the gap is equalized to a degree that the pressure differential is incapable to overcome the surface tension of the water drop.

Principle 3: Pin holes in a sealing line will produce water leakage when water runs over the pin hole areas and the sealing line is subjected to a pressure differential greater than the surface tension of the water drop.

Principle 4: Pin holes in a sealing line will not produce water leakage if no water runs over the pin hole areas even if the sealing line is subjected to a pressure differential greater than the surface tension of the water drop.

Principle 5: Vertically running water along the corner of a vertical groove tends to stay in that corner due to the increased contact surface at the corner.

This invention utilizes the above principles and a water tight vertical joint is accomplished by providing a pressure equalized chamber between the sealing lines and the exterior air as well as providing a vertical drainage groove inside or connected with the pressure equalized chamber away from the sealing lines such that no water will flow over the sealing lines. This invention is applicable to horizontal wall panel systems of any type. Only one typical composite foam panel is chosen to show on the drawings for illustrating the principles. Since no internal drainage system is required in this invention, this invention offers the most cost effective water tight vertical joint sealing system for horizontal panel wall systems.

Another objective of this invention is to provide a method of repairing water leakage in an existing horizontal exterior wall panel system utilizing the working principles of this invention. The exposed end of the sealed interior panel side joint at the vertical wall joint is most vulnerable to the water leakage problem due to panel misregistration and relative joint movement. According to this invention, a water diverting device is provided above each panel side joint to direct the water running along the panel end surface outwardly preventing the panel side joint area from being washed over by the running water.

DESCRIPTION OF THE PREFERRED EMBODIMENTS

Figure 1:
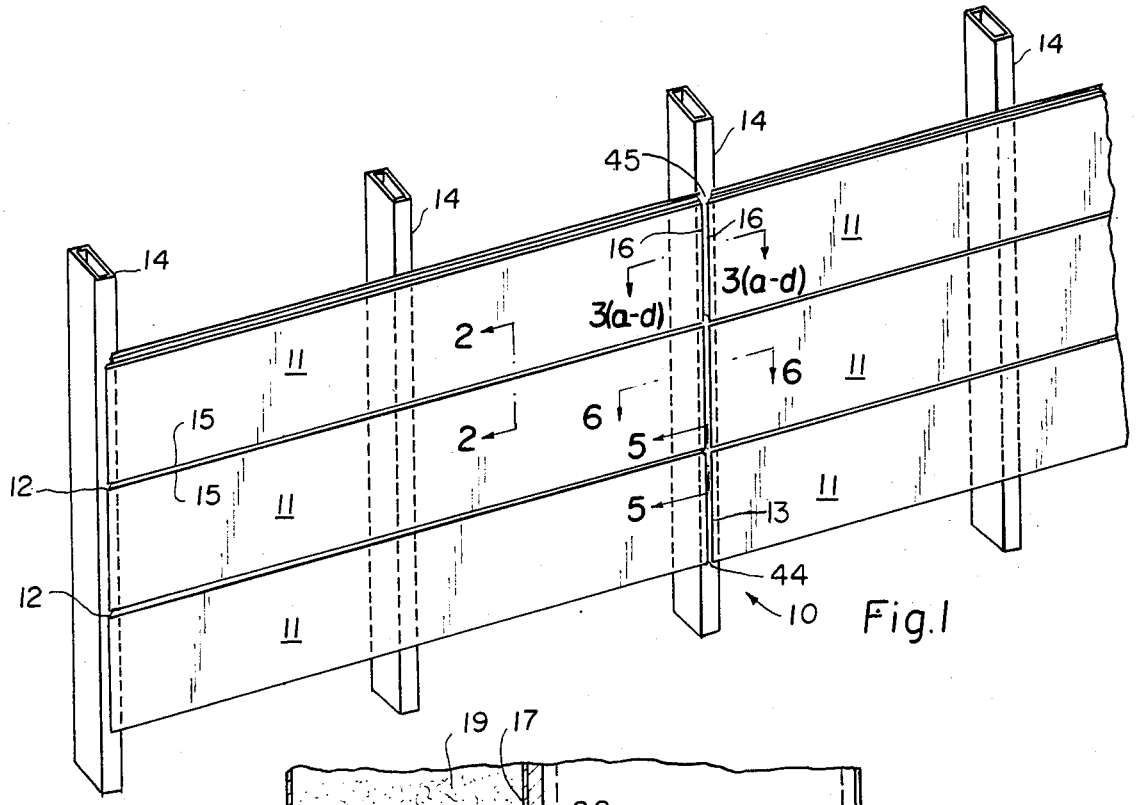
FIG. 1 is an isometric view illustrating a portion of the assembled horizontal wall panel system.

FIG. 1 illustrates a wall structure 10 consisting of multiple wall panels 11 joined together along the panel side edges 15 to form the horizontal joints 12 and spaced apart between the panel ends 16 to form the vertical joint 13. The panels 11 are securely fastened to horizontally spaced apart vertical mullions 14 which are fastened to the perimeter building frame which is not shown.

Figure 2:
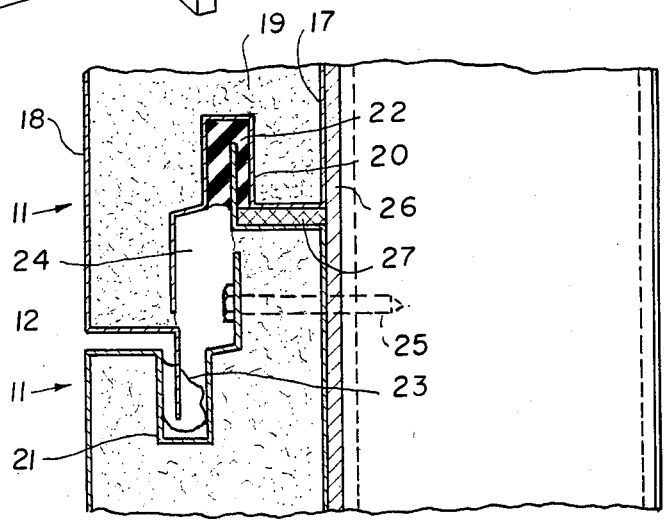
FIG. 2 is a typical fragmentary cross-sectional view taken along line 2—2 of FIG. 1 showing the sidejoint arrangement of a typical prior art wall panel.

FIG. 2 shows a typical fragmentary cross-section of the horizontal panel joint 12 taken along line 2—2 of FIG. 1. Panels 11 in this illustrative example represent a typical prior art composie foam panels having an interior metal skin 17, an exterior metal skin 18, and a closed cell structural foam core 19. The interior metal skin 17 is profiled along the panel side edges 15 to form an interlocking interior side joint 20. The exterior metal skin 18 is profiled along the panel side edges 15 to form an interlocking exterior side joint 21. The interior side joint sealant 22 is used as the primary horizontal sealing line for sealing the horizontal panel joint 12. The exterior side joint gasket 23 is used as the secondary horizontal sealing line for sealing the horizontal panel joint 12.

A horizontal side joint cavity 24 is formed to conceal the panel fastener 25. In this type of panel, the exposed foam core 19 at the panel end becomes the water repellent end closure of the panel system. Continuous vertical sealant 26 is provided between the interior panel skin 17 and the mullion 14. A marriage sealant 27 is provided at the panel end to connect the horizontal interior side joint sealant 22 to the vertical sealant 26. As shown in this construction, exterior water running on the wall surface can enter into the side joint cavity 24 from the panel ends 16 and through the exterior side joint 21. The heating and air conditioning system in the modern building creates a negative pressure inside the building causing a pressure differential across the primary sealants 22, 26 and 27. This pressure differential is further increased on the windward wall in a wind blowing rain storm.

According to Principle 3, if water runs over these primary sealants 22, 26 and 27, three possible modes of water leakage will happen. The first mode is due to water infiltration through sealant 22. This mode of water leakage can be prevented by equalizing the side joint cavity 24 to the exterior air, thus, preventing water build-up inside the cavity 24. The second mode is due to water infiltration through sealant 26. The third mde is due to water infiltration through sealant 27. There are two possible pathes for water to enter into the vertical joint cavity.

The first path is through the horizontal joint 12 and exterior joint gasket 23 into the side joint cavity 24 and dumping the water into the vertical joint cavity at the panel end 16. The second path is through the gaps or holes along the vertical joint 13. The prior art design has been trying to make perfect seal so that water can not infiltrate through sealants 22, 26 and 27. This invention is to regulate the flow of water entered into the vertical joint cavity such that no water will be in contact with the sealants 22, 26 and 27. It can be seen that sealants 22, 26 and 27 are subjected to tension, compression or shear due to side joint movements under positive and negative load cycles. Therefore, perfect seal is difficult to endure in the exterior environment.

Figure 3:
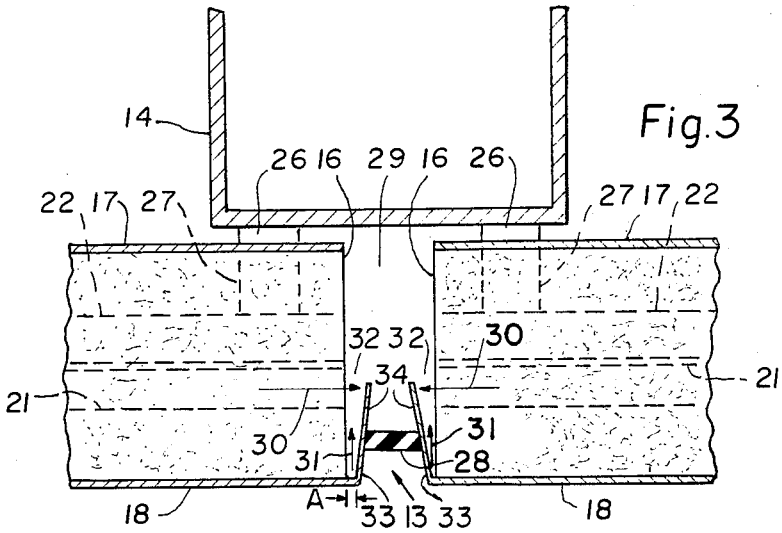
FIG. 3 is a typical fragmentary cross-sectional view taken along line 3—3 of FIG. 1 showing the pressure equalized vertical joint cavity and a typical water drainage guiding groove of this invention.

FIG. 3 shows a typical fragmentary cross-section of the vertical panel joint 13 of this invention. The vertical joint 13 is formed by spaced apart panel ends 16 and covered with a vertical joint cover 28. The vertical joint cover 28 is functioning as a rain screen to prevent water from splashing into the vertical joint 13 and as an architectural treatment of the vertical joint 13. Since there are numerous possible profiles and materials for making the vertical joint cover 28, it is only symbolically represented in FIG. 3. Vertical sealant 26 is provided between the interior metal skin 17 and the supporting mullion 14. Marriage sealant 27 is provided to connect the vertical sealant 26 to the horizontal sealant 22 in the interior panel side joint 20.

A vertical joint cavity 29 is formed by the four sides including two panel ends 16, mullion 14 and vertical joint cover 28. The arrows 30 represent water infiltrated through the exterior side joints 21 being dumped into the vertical joint cavity 29. The dotted arrows 31 represent water infiltrated through the gaps at the exterior corners of the panels 11 into the vertical joint cavity 29. According to this invention, the water infiltrated into the vertical joint cavity 29 will not be permitted to wander along the panel end surfaces 16 to make contact with sealants 22, 26 and 27. To accomplish this objective, firstly, the vertical joint cavity 29 must be pressure equalized to the exterior air. If the vertical joint cavity 29 is not pressure equalized to the exterior air, any air leakage in the sealants 22, 26 and 27 will draw more water into the vertical joint cavity 29 and enhance the tendency of sucking the water inwardly to the sealant locations. To equalize the pressure inside the vertical joint cavity 29 to the exterior air, exterior air must be allowed to freely flow into the vertical joint cavity 29. The small gaps or holes along the exterior surface of the vertical joint 13 can not be relied on for the pressure equalization purpose since these voids will be sealed off by the water running over the exterior surface preventing the passage of air. Therefore, the reliable source of air for pressure equalization must come from the bottom 44 end and/or the top end 45 of the vertical joint cavity 29 where free air passageway to the exterior exists and directs water penetration is shielded.

Such locations commonly exist at the window head gutter, wall cap and wall base. According to this principle, it is apparent that it is desirable to have the vertical joint cavity 29 as large as possible. Therefore, it is desirable to make the vertical joint cover 28 as small as possible to minimize the space occupied by the cover 28 allowing maximum vertical joint cavity 29. Theoretically, if the panel end surfaces 16 are perfectly smooth and the pressure inside the vertical joint cavity 29 is perfectly pressure equalized to the exterior air, the water entered into the vertical joint cavity 29 along the paths 30 and 31 will simply drain vertically downwardly without getting to the sealants 22, 26 and 27. However, the above stated theoretical conditions do not exist in reality. The panel end surfaces 16 can not be perfectly smooth and 100% perfect pressure equalization is almost impossible to achieve. Therefore, additional water drainage guiding system must be incorporated to ensure that the water entered into the vertical joint cavity 29 along the paths 30 and 31 will not wander inwardly toward the interior sealants 22, 26 and 27. The water drainage guiding system is accomplished by providing grooves 32 near the locations of water entering into the vertical joint cavity 29. The grooves 32 are used to contain and to drain the water downwardly. The groove 32 is formed between the panel end surface 16 and a bent extension of the exterior metal skin 18, known as panel end cap 33.

When the water is running downwardly within the grooves 32 making contact with the panel end surface 16 and the interior panel end cap surface 34, it will be difficult to force the water to wander out of the grooves 32 due to the increased surface tension resulting in double contacting surfaces within the grooves 32. The gap of the grooves 32 required to allow the water to initially form the double surface contact depends on the water surface tension which in turn, depends on the temperature. Therefore, to ensure the intended performance covering a wide range of water temperatures, a tapered groove 32 as shown in FIG. 3 is preferred. It is known that the surface tension of a water drop at the freezing point is capable of bridging over a gap of about 6 mm. The capability of a water drop to bridge over a gap gradually reduces as the water temperature increases. Therefore, the dimension a representing the narrow end of the tapered groove 32 should be less than 6 mm and is preferred to be about 3 mm. Water can also infiltrate into the vertical joint cavity 29 through any gap along the contact surfaces between the panel end caps 33 and the vertical joint cover 28. However, the water infiltrated in this manner will drain downwardly along the cover 28 or the end caps 33 without contacting the panel end surfaces 16 posing no threat to water leakage problem. In the prior art design, it is attempted to make perfect seals by using better sealant and minimizing the vertical joint cavity 29.

In this invention, water leakage is prevented by maximizing the cavity 29 and equalizing the pressure in the vertical joint cavity 29 as well as providing water drainage guiding grooves 32 without the consideration of the use of best sealant. As far as sealant type is concerned, performed sealant such as caulking tape or gasket is preferred since it will not block the vertical joint cavity. When tube caulking is used, in most cases, excessive caulking in the marriage sealant 27 will be oozed out to partially or completely block off the vertical joint cavity 29. To maintain the pressure equalization principle, it would be necessary to wipe off the oozed out caulking. This added procedure will cause additional possibility of field error.

Figure 3A:
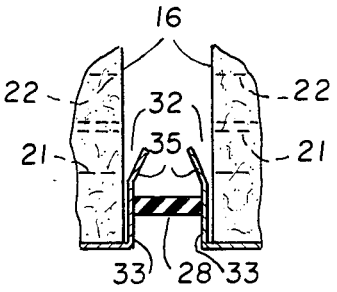
FIG. 3*a* is a modification to FIG. 3.

FIG. 3*a* shows a modification to FIG. 3 whereby the water drainage groove 32 is formed by providing an outwardly bent tip 35 in the panel end cap 33.

Figure 3B:
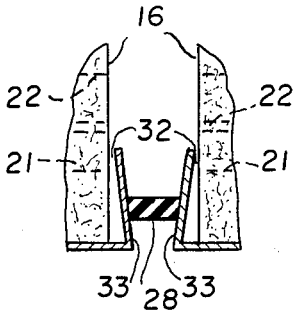
FIG. 3*b* is a modification to FIG. 3.

FIG. 3*b* shows another modification to FIG. 3 whereby the wter drainage groove 32 is formed by bending the panel end cap 33 inwardly.

Figure 3C:
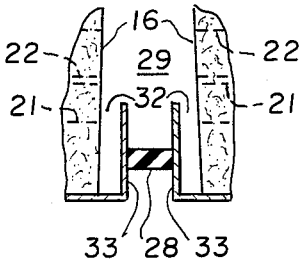
FIG. 3*c* is a modification to FIG. 3.

FIG. 3*c* shows another modification to FIG. 3 whereby the water drainage groove 32 is formed by providing a slanted panel end closure surface 16.

Figure 3D:
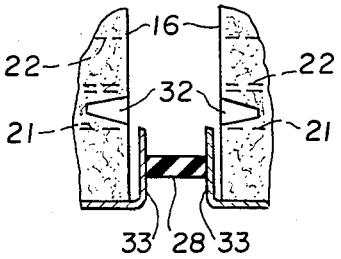
FIG. 3*d* is a modification to FIG. 3.

FIG. 3*d* shows another modification to FIG. 3 whereby the water drainage groove 32 is provided within the panel end closure surface 16.

Figure 4:
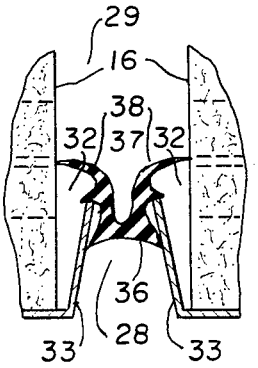
FIG. 4 shows a preferred vertical joint cover in conjunction with FIG. 3.

FIG. 4 shows a preferred vertical joint cover 28 in conjunction with the arrangements shown in FIG. 3.

The vertical joint cover 28 is made of squeezable gasket material having a front surface 36 to cover the exterior vertical joint gap, an integral first fin 37 on both sides to cause engagement with the tips of the panel end caps 33 and a second fin 38 on both sides to cause contact with the panel end surfaces 16 at the location between the interior side joint sealant 22 and the exterior side joint 21. It can be readily seem that inward movement of the vertical joint gasket 28 is prevented by the wedge action provided by the slopping panel end caps 33 and outward movement of the vertical joint gasket 28 is prevented by the engagement of the first fin 37 with the tip of the panel end cap 33. Therefore, the vertical joint gasket 28 is conventionally locked in position. The second fin 38 being in contact with the panel end surface 16 transforms the water drainage groove 32 into a water drainage spout eliminating the possibility of water wandering toward sealants 22, 26 and 27 due to roughness of the panel end surface 16. Eventhough a small gap at the contacting point between the second fin 38 and the panel end surface 16 may exist, water will not seep through the small gap due to the fact that the vertical joint cavity 29 is pressure equalized and the water contacting surface at the corner is increased. The vertical joint gasket 28 is installed after the erection of the panels 11 by squeezing it into the vertical panel joint 13.

Figure 5:
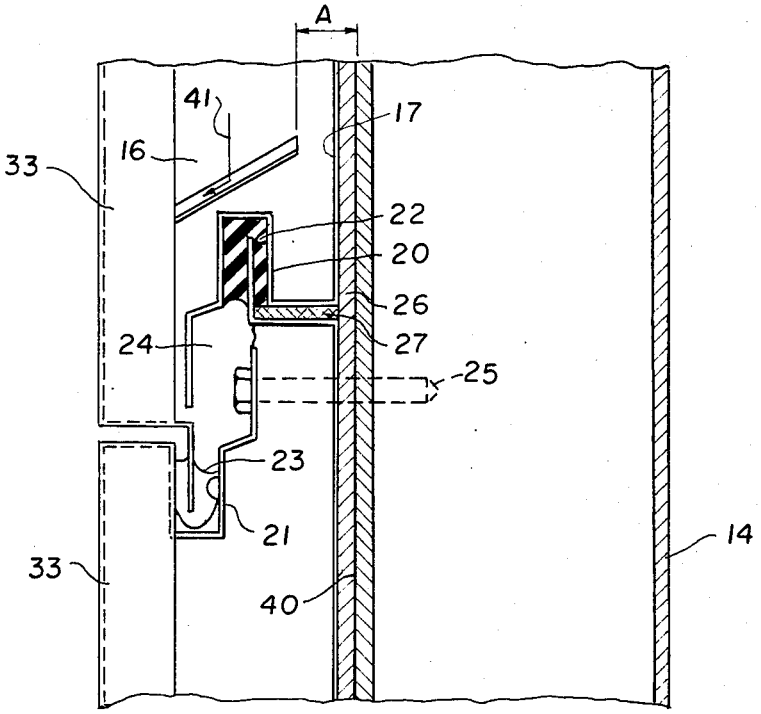
FIG. 5 is a typical fragmentary cross-sectional view taken along line 5—5 of FIG. 1 showing a water diverting device installed above the panel side joint of a typical prior art wall panel.

FIG. 5 shows a typical fragmentary cross-section of the panel end taken along line 5—5 of FIG. 1. The water diverting device 39 is installed between the confronting panel ends 16 and above the sealed interior panel side joint 20. The water diverting device 39 is sloping downwardly and outwardly ending at the panel end cap 33. It can be seen that water running downwardly along the panel end 16 will be intercepted by the water diverting device 39 and diverted outwardly away from the interior panel side joint 20. Therefore, no water will run over the interior side joint 20 and thus water leakage is prevented even if air leakage exists along the sealant lines 22, 26 and 27. It is important not to let the water diverting device 39 to occupy the entire vertical joint cavity 29 such that an air space can be maintained for equalizing the pressure inside the vertical joint cavity 29. The air space can be created at either the front end or the back end of the water diverting device 39. However, it is preferred to be at the back end where no running water is encountered. The dimension "A" is an air space between the back end of the water diverting device and the frontal surface 40 of the supporting mullion 14.

Figure 6:
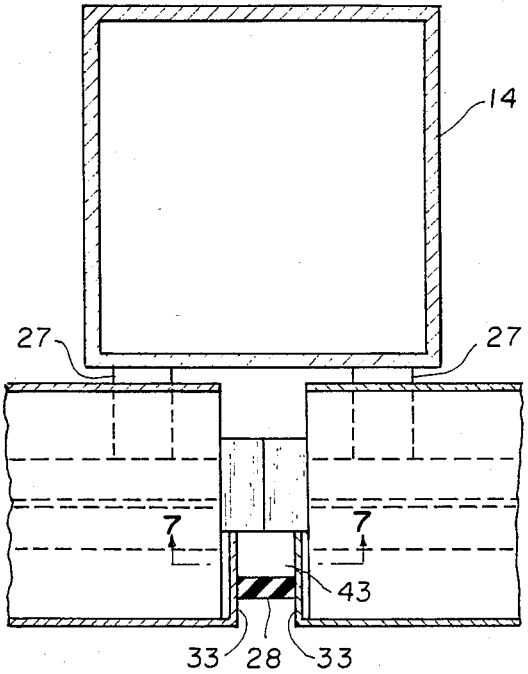
FIG. 6 is a typical fragmentary cross-sectional view taken along line 6—6 of FIG. 1 showing the location of the water diverting device looking downwardly.

FIG. 6 shows a typical fragmentary cross-section taken along line 6—6 of FIG. 1. The water diverting device 39 is secured to the confronting panel ends 16 and an air space 42 behind the water diverting device 39 is provided for pressure equalization purpose. A space 43 in front of the water diverting device 39 is provided for downward water drainage.

There are many different methods available for securing the water diverting device 39 to the panel ends 16. One of the simple methods is to allow the water diverting device 39 to penetrate into the panel ends 16.

Figure 7:
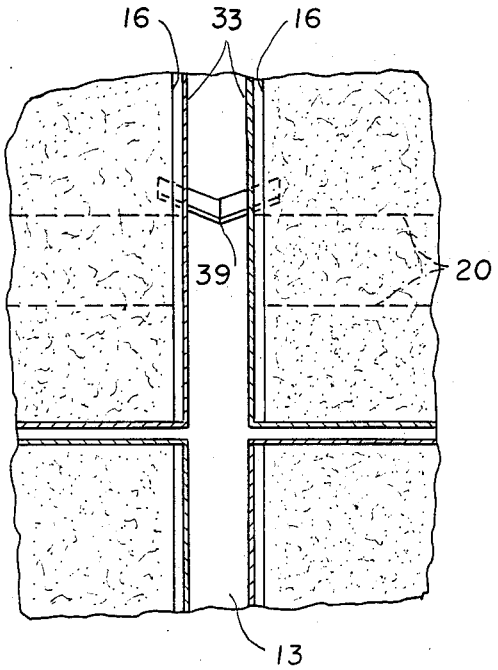
FIG. 7 is a typical fragmentary cross-sectional view taken along line 7—7 of FIG. 6.

FIG. 7 shows a typical fragmentary cross-section taken along line 7—7 of FIG. 6. The water diverting device 39 is installed above the interior panel side joint 20 and secured to the panel ends 16 by penetration. It is preferred that the water diverting device 39 is slopping downwardly from the panel ends 16 toward the center line of the vertical joint 13 as shown such that the water will drain downwardly away from the panel ends 16. There are many available materials for making the water diverting device 39 such as painted steel or aluminum plate or extruded rigid plastic.

While I have illustrated and described several embodiments on my invention, it will be understood that these are by way of illustration only and that various changes and modifications may be contemplated in my invention and within the scope of the following claims:

I claim:

1. In an exterior building panel wall assembly formed from individual building panels and supported on vertical mullions, said panels being engaged along their side edges to form horizontal wall joints and being spaced apart between their ends at said mullions to form vertical wall joints, said panel ends having exposed foam core, said horizontal wall joint being sealed internally within the depth of said panels by a horizontal sealant line, said vertical wall joint being sealed to said mullion by a vertical sealant line, said horizontal sealant line being connected to said vertical sealant line by a marriage sealant, said vertical wall joint being covered by a vertical joint cover; the improvement comprising a vertical joint cavity being maintained within said vertical wall joint inside said vertical joint cover, at least one end of said vertical joint cavity being open to a space having a free air passageway to the exterior air, said panel end having a vertical water drainage groove located in front of said horizontal sealant line, said vertical sealant line, as well as said marriage sealant and within said vertical joint cavity.

2. The water drainage groove of claim 1 is formed within said panel end closure.

3. The said vertical joint cover of claim 1 is made of a squeezable gasket material having a frontal surface to bridge over said vertical wall joint, a first fin to cause engagement with said panel end cap of claim 3, and a second fin to cause contact with said panel end in front of said horizontal sealant line, said vertical sealant line and said marriage sealant.

4. The exterior building panel wall assembly of claim 1 wherein said water drainage groove has tapered confronting sides having a minimum width not exceeding 6 mm.

5. The water drainage groove of claim 4 is formed by said panel end closure on one side and an exterior panel end cap sloping outwardly away from said panel end on the other side.

6. The water drainage groove of claim 4 is formed by said panel end closure on one side and an exterior panel end cap having a portion substantially parallel to said panel end and a portion near the tip of said end cap sloping outwardly away from said panel end on the other side.

7. The water drainage groove of claim 4 is formed by said panel end closure on one side and an exterior panel end cap sloping inwardly toward said panel end on the other side.

8. The water drainage groove of claim 4 is formed by an exterior panel end cap substantially perpendicular to the surface of said panel on one side and a slanted surface of said panel end on the other side.

9. In an exterior building panel wall assembly formed from individual building panels and supported on vertical mullions, said panels being engaged along their side edges to form horizontal wall joints and being spaced apart between their ends having exposed foam core, said horizontal wall joint being sealed internally within the depth of said panels by a horizontal sealant line, said vertical wall joing being sealed to said mullion by a vertical sealant line, said horizontal sealant line being connected to said vertical sealant line by a marriage sealant, said vertical wall joint being covered by a vertical joint cover; the improvement comprising a vertical joint cavity being maintained within said vertical wall joint inside said vertical joint cover, at least one end of said vertical joint cavity being open to a space having a free air passageway to the exterior air, a water diverting device secured to said panel ends inside said vertical wall joint above said horizontal wall joint and sloped downwardly toward said vertical joint cover.

10. The water diverting device of claim 9 has downwardly sloping surfaces from said panel ends toward the center of said vertical wall joint.

* * * * *